US005147476A

United States Patent [19]

Beck et al.

[11] Patent Number: 5,147,476

[45] Date of Patent: Sep. 15, 1992

[54] DELAY COMPOSITION AND DEVICE

[75] Inventors: Michael W. Beck, Edenvale, South Africa; John Flanagan, Ayrshire, Scotland

[73] Assignee: Imperial Chemical Industries PLC, London, England

[21] Appl. No.: 669,062

[22] Filed: Mar. 12, 1991

[30] Foreign Application Priority Data

Mar. 12, 1990 [GB] United Kingdom ..... 9005473

[51] Int. Cl.[5] ..... C06B 5/00; C06B 33/00

[52] U.S. Cl. ..... 149/37; 102/275.3

[58] Field of Search ..... 102/275.3; 149/37

[56] References Cited

U.S. PATENT DOCUMENTS

| | | | |
|---|---|---|---|
| 3,967,556 | 7/1976 | Post et al. | 102/78 |
| 4,756,250 | 7/1988 | Santos | 102/275.1 |
| 5,048,420 | 9/1991 | Beck et al. | 102/275.3 |

*Primary Examiner*—Stephen J. Lechert, Jr.
*Attorney, Agent, or Firm*—Cushman, Darby & Cushman

[57] ABSTRACT

A delay device or detonator contains a delay composition comprising a consolidated, particulate mixture of silicon and a suitable oxidant, and a minor effective proportion of dispersed metal compound intimately incorporated therewith to serve as a reaction facilitating flux, and the metal compound may be selected from alkali metal salts such as sodium chloride, sodium sulphate, potassium sulphate; lead monoxide, oxides of antimony such as $Sb_2O_3$, or $Sb_2O_5$, vanadium e.g. $V_2O_5$ or mixtures thereof.

13 Claims, No Drawings

DELAY COMPOSITION AND DEVICE

This invention relates to a novel pyrotechnic delay composition characterized by low toxicity, moisture resistance and uniform burn rate. In particular, the invention relates to a delay composition of intermediate to slow-burning time range for use in both non-electric and electric blasting caps and in inline delay devices to introduce a measured delay in initiation signal transmission to a blast charge.

Delay detonators, both non-electric and electric, are widely employed in mining, quarrying and other blasting operations in order to permit sequential initiation of the explosive charges in a pattern of boreholes. Delay between sequential initiation of adjacent pairs of shotholes is effective in controlling the fragmentation and throw of the rock being blasted and, in addition, provides a reduction in ground vibration and in air blast noise.

Modern commercial delay detonators, whether non-electric or electric, comprise a metallic shell closed at one end which shell contains in sequence from the closed end a base charge of a detonating high explosive, such as for example, PETN and an above adjacent, primer charge of a heat-sensitive detonable material, such as for example, lead azide. Adjacent the heat-sensitive material is an amount of deflagrating or burning composition of sufficient quantity to provide a desired delay time in the manner of a fuse. Above the delay composition is an ignition charge adapted to be ignited by an electrically heated bridge wire or, alternatively, by the heat and flame of a low energy detonating cord or shock wave conductor retained in the open end of the metallic shell. Such a delay detonator may serve as an in-line delay as when coupled to a detonating cord or shock wave conductor. However, a delay device need not also be capable of serving as a detonator in order, for example, to initiate a shock wave conductor. An ignition charge in close proximity to the end of the shock wave conductor instead of a base charge of detonating high explosive, will suffice.

A large number of burning delay compositions comprising mixtures of fuels and oxidizers are known in the art. Many are substantially gasless compositions; that is, they burn without evolving large amounts of gaseous by-products which would interfere with the functioning of the delay detonator. In addition to an essential gasless requirement, delay compositions are also required to be safe to handle, from both an explosive and health viewpoint, they must be resistant to moisture and not deteriorate over periods of storage and hence change in burning characteristics, and they must be adaptable for use in a wide range of delay units within the limitations of space available inside a standard detonator shell. The numerous delay composition of the prior art have met with varying degrees of success in use and application.

One such prior class of delay composition which has been well-received is that described in GB-A-2 089 336 (incorporated herein by reference) being a composition comprising silicon and barium sulphate and optionally including a proportion of red lead oxide.

There is a desire in the explosives industry to phase out all needless use of lead either as the metal (e.g. lead-drawn elements) or as compounds in delay compositions, e.g. red lead oxide as described above. The alternatives to drawn-lead tubular containment of delay compositions (as so-called drawn lead elements which are snugly fitted into the detonator shell) are drawn elements of another metal, such as aluminum, and the so-called rigid element. A rigid element is a pre-formed tube of the required dimensions made of a metal such as zinc, which does not present an environmental problem, into which the desired particulate mixture of delay composition ingredients is pressed to afford the desired delay period. The use of an inserted tubular metal element is customary but is not essential as the detonator shell itself can provide containment.

Silicon/barium sulphate delay compositions are characterized by intermediate to slow burning times, e.g. 1300 to 3200 milliseconds per centimeter of length for the two-component composition (a burning rate of from about 3.0 to 8.0 $mm.s^{-1}$.). The Applicants have found that, for reliable progressive burning of such a composition, it is important that the heat-sink effect of the metal containment of the column of delay composition should not be such as to risk quenching the exothermic reaction of the composition. This has not been found to be a problem with lead drawn elements but is found with rigid elements of which the containment is provided by a metal such as zinc, and may arise with drawn aluminum elements.

The present invention provides a delay composition (and delay detonators/devices containing a column of such composition in a delay element) wherein the composition comprises a consolidated, e.g. pressed, mixture of particulate silicon and a suitable oxidizer as the primary reactants with a minor intimately mixed proportion of a dispersed e g particulate, metal compound e.g. oxide, serving as a reaction-facilitating flux, being a metal compound that forms a liquid phase at a temperature lower than the burning temperature of the silicon-/oxidizer mixture (around 1400° C. in the case of barium sulphate).

Various oxidizers are available and this invention will be described by way of example hereinbelow mainly with reference to $BaSo_4$, which is an established preferred oxidant as described in GB-A-2 089 336, but $Fe_2O_3$ has been found effective.

Preferably, the metal compound is taken from the group consisting of alkali metal salts such as sodium chloride, sodium sulphate, potassium sulphate; oxides of antimony, preferably $Sb_2O_5$, vanadium pentoxide or lead monooxide. Thus NaCl, $Na_2SO_4$, $K_2SO_4$, $Sb_2O_5$, and $V_2O_5$ are considered to be especially useful for the purposes of the invention. Vanadium pentoxide which melts at around 600° C., somewhat lower even than the measured ignition temperature of $Si/BaSO_4$ delay compositions (around 680° C.) is especially preferred. The molten flux obtainable using any of the aforesaid metal compounds improves the reaction by apparently facilitating the reaction between the elemental silicon and the oxidant.

Preferably, the flux is one which provides a reaction-facilitating role in the reaction between silicon and an oxidant such as barium sulphate without itself participating in any dominant chemical reaction with the elemental silicon or the oxidant to the extent that the character of the delay composition is materially affected. Thus, the flux should most preferably be substantially inert as judged by the effect of its presence on the burning rate of the composition relative to the equivalent formulation not containing the flux, (disregarding the inert diluent effect of the flux material at higher proportions of flux, say greater than 5% by weight). However, the preference for inertness, as defined above, does not preclude the flux being consumed nor some speeding up of the burning front and, indeed, in the case of $V_2O_5$ in $Si/BaSO_4$ systems, it becomes involved in complex mixed oxide formation, as analysis of reaction products indicates, probably containing $V^{4+}$ species as well as $V^{5+}$ species.

The relative proportions of the essential ingredients may be as described in the GB-A-2 089 336 for silicon and barium sulphate (that is, from 55:45 to 30:70 parts by weight $Si:BaSO_4$) and in the case of the flux e.g., $V_2O_5$ it should be at least about 1% of the total weight of the silicon, oxidant and flux components, more preferably from about 2 to 5% by weight. A highest acceptable proportion of flux cannot be specified at this time but it is expected that substantially increasing the proportion of flux, beyond say about 10% by weight is likely to give diminishing returns in that any reaction facilitating role of the flux will be offset by the inert diluent effect and tend to quench the reaction. Therefore a value of about 10% by weight represents a very convenient amount for many compositions in accordance with the invention.

The advantage of a minor effective amount of flux, e.g. $V_2O_5$, is that it does not substantially alter the essential character of the $Si/BaSO_4$ composition as an intermediate to slow burning composition (i.e. it does not substantially speed up or slow down the burning rate) but its presence does impart to the composition resistance to quenching by the heat-sink effect of the metal tubular containment so that the composition is effective in rigid elements such as the otherwise already-used zinc elements.

Rigid elements containing the compositions of the invention have shown themselves in tests to be effective as reliable, reproducible delay elements within the confines of the standard detonator shell dimensions familiar in the art providing delays of from about 0.5 seconds to, say 8.5 seconds or even higher. The rigid elements tested were in fact zinc elements, being the presently preferred containment metal for rigid elements, but might of course have been made of another suitable material, e.g. aluminum.

The present compositions will function in lead drawn elements but, as stated above, the environmental benefit of avoidance of unnecessary use of lead is not achieved. Red lead oxide or another reactive ingredient that would cause a faster rate of burning may be incorporated if desired. At large loadings of such a reactive ingredient the facilitating role of the flux may not be felt. Preferably, therefore, the composition consists of, or consists essentially of (i.e. ignoring incidental or adventitious minor impurities or ingredients), Si, $BaSO_4$ or other oxidant and the flux.

The invention will now be further described by way of the following Examples 2–10 which are illustrative of delay compositions according to the invention, and of detonators and delay devices, also according to the invention.

EXAMPLE 1

(Comparative)

A delay composition containing silicon (specific surface area of 7 $m^2/g$) and barium sulphate (0.8 $m^2/g$) in the mass ratio 45.5:54.5 was prepared by a wet mixing process and subsequently dried and sieved. The composition was then consolidated to a density of around 2 $g/cm^3$ in a 22 mm long zinc delay element (i.d. 3.1 mm, o.d. 6.4 mm) containing a 6 mm long fast burning igniting/sealing composition. The effective delay column length was therefore 16 mm. The delay element was encased in a delay detonator containing a suitable base charge and initiation was achieved by means of a shock wave conductor. A sample of twenty detonators was attempted, but in all cases the main charge was incapable of sustaining combustion over an appreciable distance.

EXAMPLE 2

The above experiment was repeated with the addition of vanadium pentoxide ($V_2O_5$) to the $Si/BaSO_4$ delay composition at a mass percentage of 1% and in fine particulate form as supplied for laboratory purposes. Eighteen detonators out of a sample of 20 fired successfully with an average delay time of $3.550 \pm 0.072$ s. Examination of the two misfired detonators revealed that the main delay column had been initiated but had failed to propagate along the entire length of the column.

EXAMPLE 3

The above example was repeated with the $V_2O_5$ composition increased to 2%. All twenty detonators fired and a mean delay time of $3.562 \pm 0.103$ was obtained.

EXAMPLE 4

In this example the $V_2O_5$ concentration was increased to 4.5%. All 20 detonators fired with an average delay time of $3.523 \pm 0.066$ s.

EXAMPLE 5

Increasing the $V_2O_5$ content to 10% similarly did not substantially alter the burning rate. All 20 detonators fired and an average delay time of $3.550 \pm 0.088$ s was measured.

EXAMPLE 6

Zinc delay elements were loaded as per the procedure of Example 2 except that the $V_2O_5$ was replaced by $Sb_2O_3$ present at 10% by mass. It was observed that 12 of the 20 detonators fired and an average burning speed of 4.5 $mm.s^{-1}$ was obtained.

EXAMPLE 7

The procedure of Example 6 was repeated except that the $Sb_2O_3$ was replaced by $Sb_2O_5$. It was observed that 19 of the 20 detonators fired and an average burning speed of 4.8 $mm.s^{-1}$ was obtained.

EXAMPLE 8

In this example and the next, the compositions were loaded into a stainless steel combustion channel of larger internal dimension (6 mm × 10 mm × 30 mm) than a standard delay element and the wall thickness was reduced to 1 mm to reduce heat losses. The delay column was consolidated to a density of around 1.8 $g/cm^3$ and initiation was achieved by means of an electric fusehead. The delay column was not confined in a detonator and delay times were determined by means of two thermocouples embedded in the column and separated by a distance of 14 mm.

In this configuration the composition prepared in example 1 was able to sustain combustion and a mean delay time of $3.9 \pm 0.5$ s was obtained.

EXAMPLE 9

The above experiment was repeated with a delay composition containing 10% $V_2O_5$ as used in example 5. An average delay time of 3.84±0.2 s was measured.

EXAMPLE 10

A delay composition containing silicon (specific surface area of 5–6 $m^2/g$) and ferric oxide (3–4 $m^2/g$) in the mass ratio 30:70 was prepared as before and 10% by mass of sodium sulphate ($Na_2SO_4$) was intimately mixed therewith. Zinc delay elements were loaded as per standard procedures in the industry with this composition and initiated using a shock wave conductor. It was observed that a maximum burning speed of about 8.75 $mm.s^{-1}$ was obtained with this composition.

What we claim is:

1. A delay composition comprising a consolidated, particulate mixture of silicon and a suitable: oxidant, and a minor effective proportion of dispersed metal compound intimately incorporated therewith to serve as a reaction facilitating flux.

2. The delay composition of claim 1 wherein the metal compound is selected from the group consisting of alkali metal salts, oxides of antimony and oxides of vanadium.

3. The delay composition of claim 1 wherein the metal compound is selected from the group consisting of NaCl, $Na_2SO_4$, $K_2SO_4$, $Sb_2O_3$, $Sb_2O_5$, PbO, $V_2O_5$ and mixtures thereof.

4. The delay composition of claim 1 wherein the metal compound is $V_2O_5$.

5. The delay composition of any one of claims 1 to 4 wherein the metal compound is present in the composition in an amount of from about 1% to about 10% and above by mass.

6. The delay composition of any one of claims 1 to 4 wherein the metal compound is present in the composition in an amount of from about 2% to about 5% by mass.

7. The delay composition of any one of claims 1 to 4 wherein the metal compound is present in the composition in an amount of about 10% by mass.

8. A delay device or detonator comprising the delay composition according to claim 1.

9. The delay device or detonator of claim 8 wherein a rigid element delay is present.

10. The delay device or detonator of claim 8 wherein the delay composition consists essentially of silicon as fuel, barium sulphate as oxidant and vanadium pentoxide as flux and has a burning rate of from about 3.0 to 8.0 $mm.s^{-1}$.

11. The delay device or detonator of claim 8 wherein the delay composition consists essentially of silicon as fuel, ferric oxide as oxidant and sodium sulphate as flux and has a burning rate of from about 3.0 to 9.0 $mm.s^{-1}$.

12. The delay device or detonator of claim 9 or claim 10 wherein the delay composition contains silicon and oxidant in a ratio by mass of from 55:45 to 30:70.

13. The delay device or detonator of claim 8 wherein the overall time delay provided thereby is of from about 0.5 seconds to about 8.5 seconds.

* * * * *

UNITED STATES PATENT AND TRADEMARK OFFICE

CERTIFICATE OF CORRECTION

PATENT NO. : 5,147,476

DATED : September 15, 1992

INVENTOR(S) : BECK et al.

It is certified that error appears in the above-identified patent and that said Letters Patent is hereby corrected as shown below:

On the title page: Item [75]

Please add the name Moira Logan as co-inventor

Signed and Sealed this

Twenty-sixth Day of October, 1993

*Attest:*

Bruce Lehman

BRUCE LEHMAN

*Attesting Officer*

*Commissioner of Patents and Trademarks*